US005392034A

United States Patent [19]

Kuwagaki

[11] Patent Number: 5,392,034

[45] Date of Patent: Feb. 21, 1995

[54] VEHICLE CLASSIFICATION SYSTEM USING PROFILE

[75] Inventor: Hiroyuki Kuwagaki, Kawasaki, Japan

[73] Assignee: Kabushiki Kaisha Toshiba, Kawasaki, Japan

[21] Appl. No.: 14,226

[22] Filed: Feb. 5, 1993

[30] Foreign Application Priority Data

Feb. 7, 1992 [JP] Japan ..... 4-022920

[51] Int. Cl.[6] ..... G08G 1/01

[52] U.S. Cl. ..... 340/933; 340/942; 340/937; 364/436; 367/97; 377/9; 377/26

[58] Field of Search ..... 340/933, 943, 941, 942, 340/937; 364/436; 367/97; 377/6, 9, 26

[56] References Cited

U.S. PATENT DOCUMENTS 4,709,264 11/1987 Tamura et al. ..... 340/937

FOREIGN PATENT DOCUMENTS 0029776 3/1978 Japan ..... 340/933
0013304 1/1982 Japan ..... 340/933
61-216097 9/1986 Japan .
0158899 6/1990 Japan ..... 340/933
0277198 11/1990 Japan ..... 340/933
0188599 8/1991 Japan ..... 340/933
3180999 8/1991 Japan .
403260897 11/1991 Japan ..... 340/933
403265999A 11/1991 Japan ..... 340/933
404354100A 12/1992 Japan ..... 340/933

*Primary Examiner*—John K. Peng
*Assistant Examiner*—Nina Tong
*Attorney, Agent, or Firm*—Cushman Darby & Cushman

[57] ABSTRACT

A vehicle classification system automatically identifies types of vehicles traveling along a vehicle lane of toll road. The system has a detector for detecting the passage of the vehicle at a plurality of positions along the vehicle lane. The system further has a pickup device for picking up profile information of the vehicle in accordance with the detected passage and an identification device for identifying the vehicle type based on the detected profile information.

4 Claims, 7 Drawing Sheets

VEHICLE CLASSIFICATION SYSTEM USING PROFILE

BACKGROUND OF THE INVENTION

1. Field of the Invention

This invention relates to a vehicle classification system for identifying the types of vehicles traveling along a toll road, and it more particularly relates to such a vehicle classification system using a profile of the vehicle.

2. Description of the Related Art

Generally, in a toll roads, a toll booth operator collects tolls at a toll gate of the toll road. In this case, if the type of vehicles can be automatically identified, the above collection may be automatically transacted.

That is, a method is to detect the height of a vehicle, the number of axles, the width of tires, single/double tires, tread, the length of a compact vehicle, licence plate information such as licence number and the type of vehicle and the like and identify the vehicle type based on the detected information.

However, with the above conventional vehicle type identification method, since a so-called treadle is used as a means for detecting the number of axles of the vehicle, tire width, single/double tires, tread and the like, a problem that a sufficient durability cannot be attained occurs. Further, since the road surface must be dug to install the treadle, a problem that the construction becomes troublesome occurs, particularly, in the high level road.

Further, since the shape of a vehicle cannot be detected by the conventional vehicle classification method, the vehicle classification cannot be correctly effected, particularly, buses and trucks cannot be distinguished from each other and the vehicle type may be erroneously determined when the information on the licence plate cannot be identified (detected).

SUMMARY OF THE INVENTION

An object of this invention is to provide a vehicle classification system whose durability, reliability and identification precision can be enhanced and which is easily installed.

The present invention comprises a first detecting means for detecting the passage of a vehicle. The first detecting means has a plurality of first light detecting elements which are disposed so as to be substantially parallel to the passage direction of the vehicle. Each first light detecting elements successively detects the passage of the vehicle. A second detecting means for detecting a profile of the vehicle is also provided. The second detecting means may have a plurality of second light detecting elements disposed perpendicular to the passage direction of the vehicle. The second detecting means repeatedly detects a part of the profile of the vehicle in accordance with the detected passage of the vehicle by the first detecting means. Thus, when the entire vehicle has passes by the second detecting means, the full profile of the vehicle is obtained by the combination of all the parts of the profile. A storing means stores a plurality of reference profiles. The apparatus includes means for comparing the profile detected by the second detecting means with at least one of the reference profiles. Finally, the apparatus contains means for identifying the vehicle type based upon the comparison made by the comparing means.

With the above technique of this invention, a vehicle classification system whose durability, reliability and identification precision can be enhanced and which can be easily installed can be obtained.

That is, in this invention, the vehicle classification is identified based on the profile information derived by the profile information picking means. Therefore, unlike the prior art, it is not necessary to use a treadle on which a vehicle is set to derive the information of the vehicle. The vehicle information picking up means is disposed on the side portion of the traveling path and a vehicle will not directly step on the picking up means so that the durability can be significantly enhanced and the high reliability can be attained.

Since the treadle can be omitted and it is not necessary to dig the road, the system can be easily installed and can be easily disposed on the already constructed high level road. Further, since the form of the vehicle can be identified by picking up the profile of the side surface of the vehicle, the possibility it decline and the identification precision can be enhanced even when licence plate information cannot be recognized because the vehicle type cannot be detected and the vehicle type is erroneously detected.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

There will now be described an embodiment of this invention with reference to the accompanying drawings.

Figure 1:
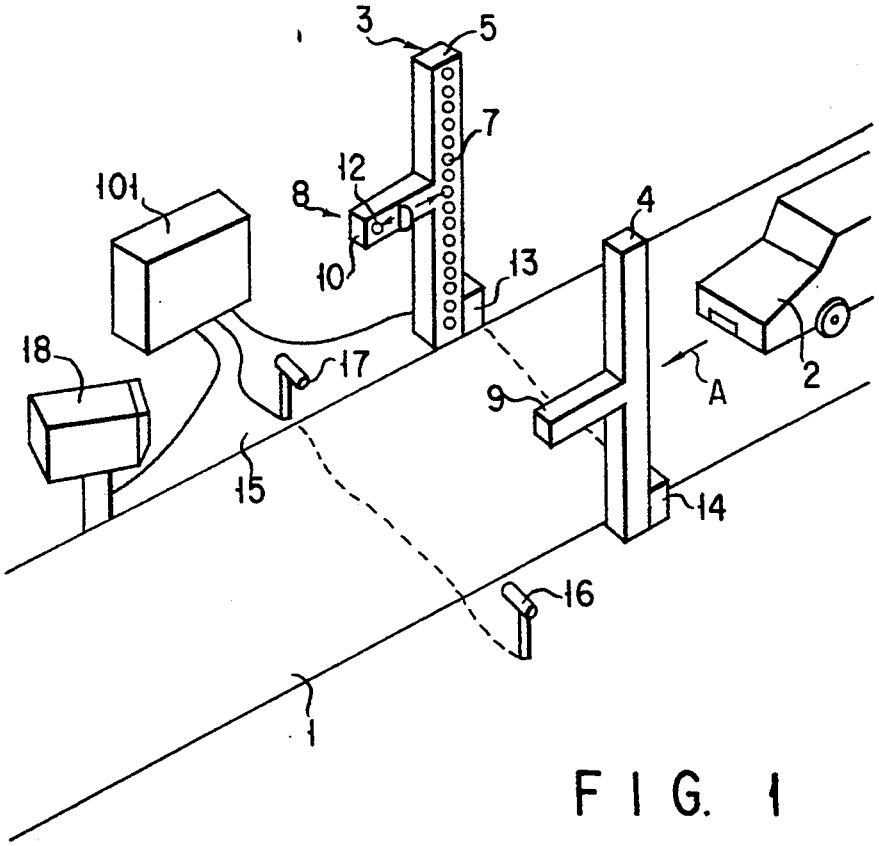
FIG. 1 is a perspective view showing an example of the arrangement of various types of sensors used in this invention and disposed in the entrance gate of the toll gate of a toll road.

FIG. 1 shows an example of the arrangement of various types of sensors used in a vehicle type identification system of this invention. In FIG. 1, a vehicle 2 entering the entrance gate will run along a traveling path 1 in the entrance gate of the toll gate of a toll road in a direction indicated by an arrow A, for example. An optical sensor device 3 used as an profile information detecting means for detecting profile information of the side surface of the vehicle 2 coming into the toll gate is disposed on the side portion of the traveling road 1. The optical sensor device 3 is constructed by a large number of optical sensors.

That is, the optical sensor device 3 includes a light emitting unit 4 disposed on one side portion of the traveling road 1 and a light receiving unit 5 disposed on the other side portion of the traveling road 1 to face the light emitting unit 4 and the vehicle 2 is permitted to pass through a space between the light emitting unit 4 and the light receiving unit 5. In this case, the light emitting unit 4 and the light receiving unit 5 are disposed in such positions as to face the respective side surfaces of the vehicle 2 coming into the entrance gate.

For example, the light emitting unit 4 is a line light source having a large number of light emitting elements 6,—(not shown) as light sources arranged on a line extending in a direction perpendicular to the traveling direction of the vehicle 2. Further, the light receiving unit 5 is a line sensor having a large number of light receiving elements 7,—corresponding to the light emitting elements 6 of the light emitting unit 4 and arranged on a line extending in a direction perpendicular to the traveling direction of the vehicle 2.

In the intermediate portions of the light emitting unit 4 and light receiving unit 5 of the optical sensor device 3, a light emitting unit 9 and a light receiving unit 10 constituting a velocity detection sensor 8 for detecting the velocity of the vehicle 2 are provided. The light emitting unit 9 includes a light emitting element 11 (not shown) and the light receiving unit 10 includes a light emitting element 12.

Vehicle width measuring ultrasonic sensors 13 and 14 for measuring the width of the vehicle 2 are disposed near the light emitting unit 4 and light receiving unit 5 of the optical sensor device 3.

In forward positions at a preset distance from the light emitting unit 4 and light receiving unit 5 of the optical sensor device 3, a light emitting unit 16 and a light receiving unit 17 constituting a vehicle length sensor 15 for compact vehicles for detecting the length of light vehicles are provided.

In forward positions of the light emitting unit 16 and light receiving unit 17 of the vehicle length sensor 15 for light vehicles, a photographing unit 18 for photographing an image of the front licence plate portion of the vehicle 2 coming into the entrance gate is provided. For example, the photographing unit 18 is constructed by an industrial television camera and a strobo light emitting unit.

Figure 2:
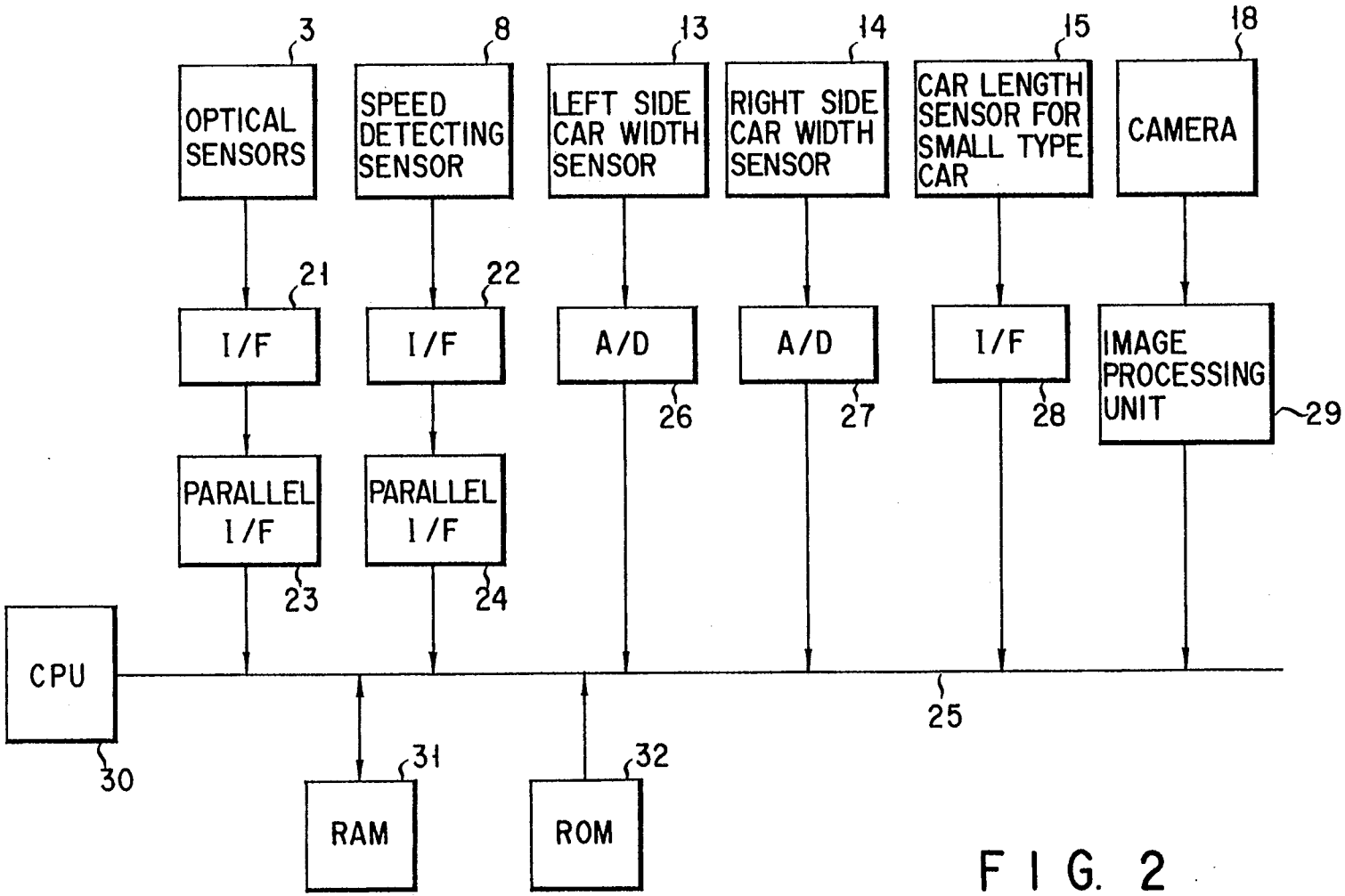
FIG. 2 is a block diagram showing the construction of a vehicle type identification system according to one embodiment of this invention.

FIG. 2 shows the construction of a vehicle type identification system according to this invention. That is, outputs of the optical sensor device 3 and the velocity detection sensor 8 are converted to TTL level signals by interfaces 21 and 22 and then supplied to parallel interfaces 23 and 24, respectively. Output terminals of the parallel interfaces 23 and 24 are connected to a bus 25.

Outputs of the vehicle width measuring ultrasonic sensors 13 and 14 are converted to TTL level digital data by A/D converters 26 and 27, respectively, and then supplied to the bus 25. An output of the vehicle length sensor 15 for light vehicles is converted to a TTL level signal by an interface 28 and then supplied to the bus 25. An output of the photographing unit 18 is supplied to an image processing unit 29 which in turn recognizes information on the licence plate of the vehicle 2 and the result of recognition is output to the bus 25.

A CPU (central processing unit) 30 for controlling the whole operation, a RAM (random access memory) 31 for storing various data, and a ROM (read only memory) 32 are connected to the bus 25. The ROM 32 stores the control program of the CPU 30, reference information (such as reference patterns indicating the whole portion of the vehicle, the front end portion of the vehicle and the rear end portion of the vehicle) and the like.

Figure 3:
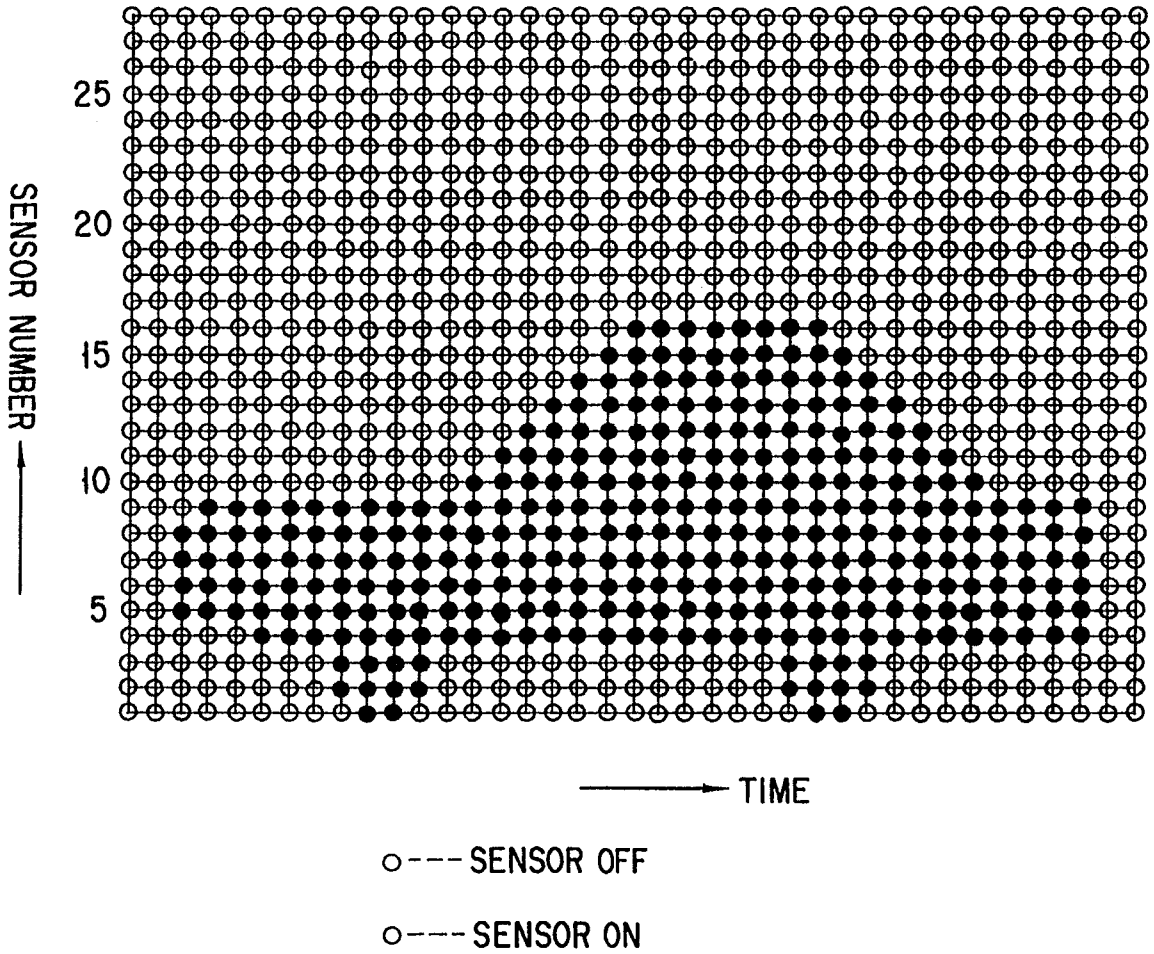
FIG. 3 is a diagram for illustrating a method of detecting profile information in this invention.

Now, the operation of the vehicle type identification system with the above construction is explained. When the vehicle 2 coming into the entrance gate passes through between the light emitting unit 4 and light receiving unit 5 of the optical sensor device 3, the CPU 30 periodically reads the lightness of the light receiving elements 7,—of the light receiving unit 5 as shown in FIG. 3, and then temporarily stores the information into the RAM 31 so as to derive the profile information of the side surface of the vehicle 2. On the lightness of the light, OFF state means no detection of the vehicle, ON state means detection of the vehicle. At this time, since the profile information may be extended or compressed according to the velocity of the vehicle 2, the CPU 30 corrects the profile information. The operation of correcting the profile information is effected as follows.

That is, if time at which the light receiving element 12*a* becomes ON by reach or passage of the front end portion of the vehicle 2 in the light emitting unit 9 and light receiving unit 10 of the velocity detection sensor 8 is T1, time at which the light receiving element 12*b* disposed at the same height as the light receiving element 12*a* becomes dark in the light receiving unit 5 of the optical sensor device 3 is T2, and a distance between the two light receiving elements 2*a* and 12*b* is D, then the velocity Vf of the vehicle 2 coming into the entrance gate can be expressed by the following equation (1)

$$Vf = D/(T2 - T1) \quad (1)$$

Likewise, if time at which the light receiving element 7 becomes OFF in the light receiving unit 5 of the optical sensor device 3 is T3 and time at which the light receiving element 12*b* of the velocity detection sensor 8 becomes OFF is T4, then the velocity VR of the vehicle going out from the gate can be expressed by the following equation (2)

$$VR = D/(T4 - T3) \quad (2)$$

The CPU 30 corrects and normalizes the profile information in the RAM 31 based on the velocities Vf and VR expressed by the equations (1) and (2) and derive input information (input pattern).

Figure 4:
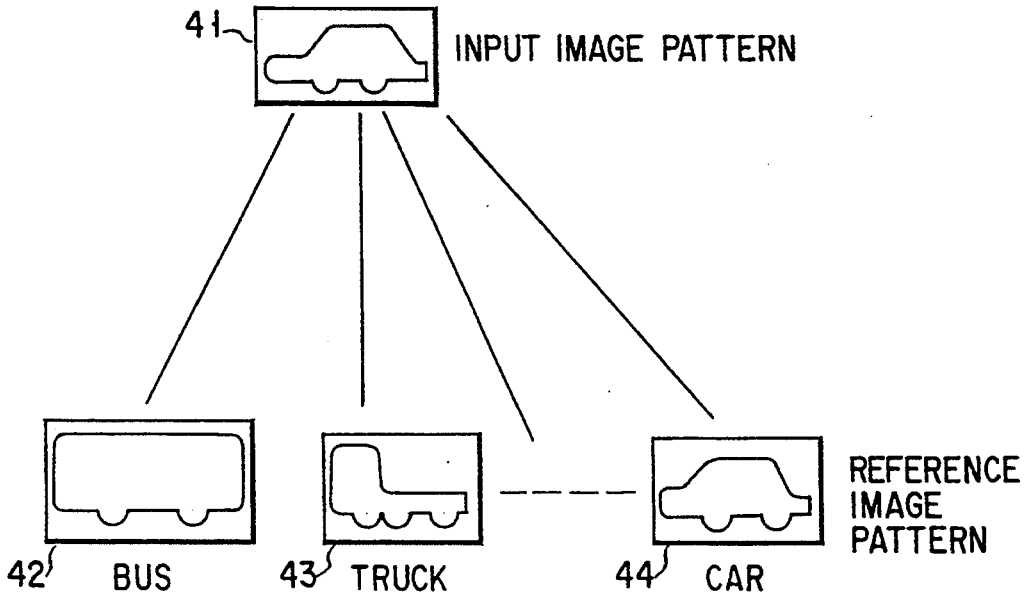
FIG. 4 is a diagram for illustrating a method of effecting the process of pattern matching between reference information and profile information in this invention.

Next, as shown in FIG. 4, the CPU 30 effects the process of pattern matching between the input information (input pattern) and reference information items (reference patterns) previously stored in the ROM 32, calculates the similarity between them and detects the reference information item which causes the largest similarity. It is understood in the example shown in FIG. 4 that the input information is most similar to the reference information item of a two-axle middle-sized vehicle. Therefore, the CPU 30 determines that the vehicle 2 coming into the entrance gate is a two-axle middle-sized vehicle.

At this time, since the velocity VR is the velocity of the front end portion of the vehicle 2, there occurs a possibility that correct normalization of the profile cannot be attained at the rear end portion of the vehicle when the profile of the whole vehicle is determined by use of the above velocity.

Therefore, in this embodiment, the performance of vehicle type identification is enhanced by extracting the profile of a portion (which is the front end portion in this example) used for measuring the velocity VR from the whole portion and comparing the extracted profile information with the reference information items (reference patterns) of the front end portion of a vehicle previously registered in the ROM 32 by use of the CPU 30.

Figure 5:
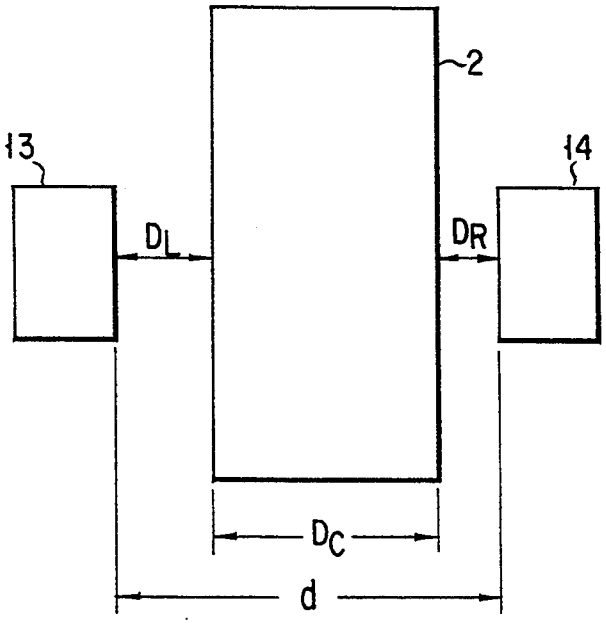
FIG. 5 is a diagram for illustrating a method of measuring the width of a vehicle in this invention.

The vehicle width information is derived by the following method. That is, in the vehicle width measuring ultrasonic sensors 13 and 14, if a distance between the ultrasonic sensor 13 and the vehicle 2 is DL, a distance between the ultrasonic sensor 14 and the vehicle 2 is DR and a distance between the ultrasonic sensors 13 and 14 is d as shown in FIG. 5, then the vehicle width DC can be expressed by the following equation (3).

$$DC=d-DL-DR \quad (3)$$

Therefore, the CPU 30 derives vehicle width information by calculating the equation (3) based on information items from the vehicle width measuring ultrasonic sensors 13 and 14.

Next, a compact vehicle is determined in the following manner. That is, a distance between the light emitting unit 16 and light receiving unit 17 of the vehicle length sensor 15 for compact vehicles on one hand and the light emitting unit 4 and light receiving unit 5 of the optical sensor device 3 on the other is set to a limited value of a legal vehicle length of the compact vehicle, and if the CPU 30 detects that the vehicle length sensor 15 for compact vehicles is bright when the vehicle 2 has departed from the entrance gate, the CPU 30 determines that the vehicle may be a light vehicle.

Information on the licence plate of the vehicle 2 is recognized in the following manner. That is, when the optical sensor device 3 detects the front end portion of the vehicle 2, the CPU 30 supplies a vehicle detection signal to the image processing unit 29. When receiving the vehicle detection signal, the image processing unit 29 supplies a strobo light emission instruction signal to the photographing unit 18. When receiving the strobo light emission instruction signal, the photographing unit 18 drives the strobo light emitting unit in synchronism with the shutter and supplies a freeze signal to the image processing unit 29. When receiving the freeze signal, the image processing unit 29 fetches image information from the photographing unit 18 at this timing, subjects the same to the A/D conversion and stores the same into an internal image memory. Then, the licence plate area is extracted by effecting a known image processing operation and the area is subjected to the character recognition process to derive a two-digit vehicle type number (vehicle type code).

As described above, profile information of the side surface of the vehicle 2 is derived by use of the optical sensor device 3 and velocity detection sensor 8 and the vehicle type and the number of axles are derived by effecting the process of pattern matching between the derived profile information and the reference information items. Further, vehicle width information is derived based on information from the vehicle width measuring ultrasonic sensors 13 and 14. Then, the possibility that it may be a compact vehicle is determined based on the information from the vehicle length sensor 15 for light vehicles. Further, the vehicle type number of the licence plate is derived by use of the photographing unit 18 and image processing unit 29. The CPU 30 makes a general judgment based on the above various information items to determine the final vehicle type and output the result of determination.

Thus, the profile information of the side surface of the vehicle is derived by use of the optical sensor device and subjected to the pattern matching process together with the reference information items to determine the vehicle type so that the vehicle type identification can be effected without using a treadle unlike the conventional case. As a result, the durability can be significantly enhanced and the reliability can be improved. Further, since the treadle is not used and therefore it is not necessary to dig the road, it can be easily installed and can be easily disposed on the already constructed high level road.

Further, since the type of a vehicle (sedan, wagon, truck or bus) can be determined according to the profile information of the side surface of the vehicle, the possibility that the vehicle type cannot be detected or the vehicle type is erroneously detected becomes low and the identification precision can be enhanced even when information on the licence plate cannot be recognized.

In the above embodiment, the velocity of the vehicle is detected by use of the optical velocity detection sensor, but it is also possible to detect the velocity by use of a speed meter utilizing the Doppler effect, for example.

Further, since the profile information can be correctly normalized and the vehicle length can be determined if the velocity of the vehicle in a period from arrival to departure is correctly detected, it becomes unnecessary to use a vehicle length sensor for compact vehicles.

In the above embodiment, the number of axles of the vehicle is determined by effecting the process of pattern matching between the profile information and the reference information, but it is also possible to independently determine the number of axles by detecting the tire or the like of the profile information.

Figure 6:
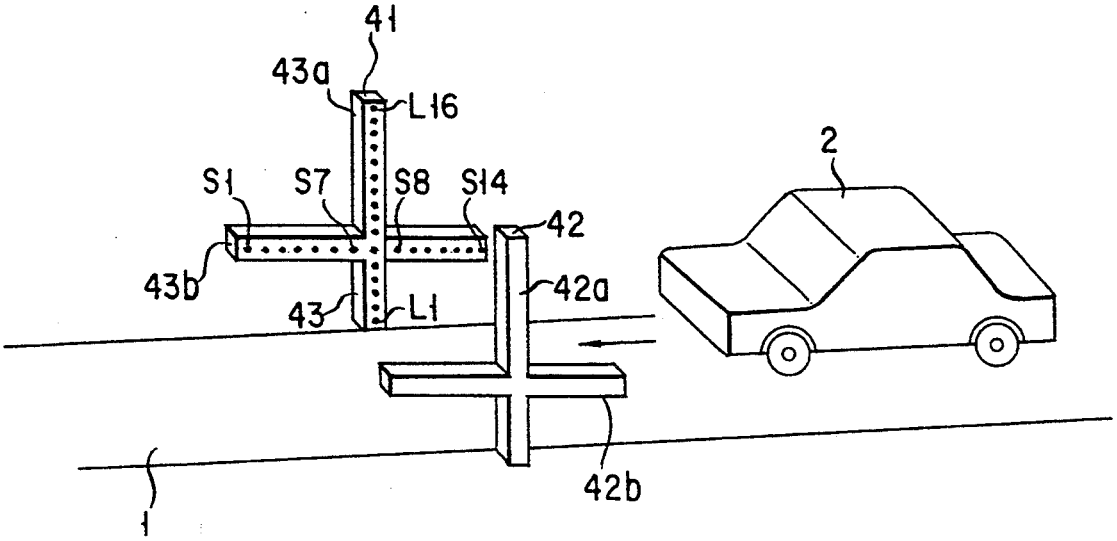
FIG. 6 is a perspective view showing an example of the arrangement of various sensors used in a vehicle type identification system according to another embodiment of this invention.

Further, as another embodiment, it is possible to detect profile information of the side surface of a vehicle and determine the vehicle type by using optical sensors arranged in a vertical direction and optical sensors arranged in a horizontal direction in combination as shown in FIG. 6, for example, without using the velocity detection sensor. The embodiment is described in detail below.

As shown in FIG. 6, an optical sensor device 42 used as a profile information detection means for deriving profile information of the side surface of a vehicle 2 coming into the gate is disposed on the side portion of a traveling path 1. The optical sensor device 41 includes a "+"-shaped light emitting unit 42 disposed on one side of the traveling path 1 and a "+"-shaped light receiving unit 43 disposed on the other side of the traveling path 1 to face the light emitting unit 42, and the vehicle 2 is permitted to pass through a space between the light emitting unit 42 and the light receiving unit 43.

The light emitting unit 42 has a large number of light emitting elements (not shown) linearly arranged on a vertical portion 42*a* thereof and a large number of light emitting elements (not shown) linearly arranged on a horizontal portion 42*b*.

The light receiving unit 43 has a large number of light receiving elements L1 to L16 linearly arranged on a vertical portion 43*a* thereof to face the corresponding light emitting elements of the vertical portion 42*a* of the light emitting unit 42 and a large number of light emitting elements S1 to S16 linearly arranged on a horizontal portion 43*b* to face the corresponding light emitting elements of the horizontal portion 42*b* of the light emitting unit 42.

The positions of the light emitting unit 42 and light receiving unit 43 are determined such that the vertical portions 42*a* and 43*a* may be set parallel to a direction perpendicular to the traveling direction of the vehicle 2, the horizontal portions 42*b* and 43*b* may be set parallel to the traveling direction of the vehicle 2 and the light emitting unit 42 and light receiving unit 43 may be set to face the respective side surfaces of the running vehicle 2.

The optical sensor device 41 of the above construction is connected to the bus 25 via the interface 21 and parallel interface 23 instead of the optical sensor device 3 in the first embodiment shown in FIG. 2. In this case, it is not necessary to use the velocity detection sensor 8, interface 22 and parallel interface 24.

Figure 7:
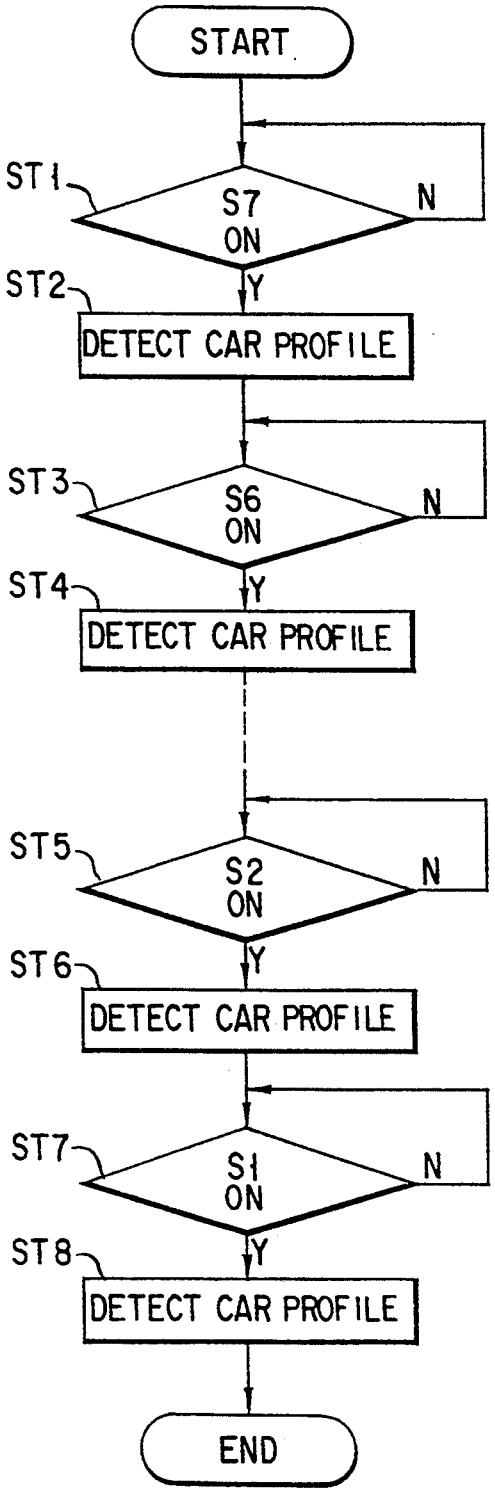
FIG. 7 is a flowchart for illustrating the operation of detecting profile information of the front end portion of a vehicle in this invention.

The operation of detecting profile information of the front end portion of a vehicle effected by use of the above construction is explained with reference to the flowchart shown in FIG. 7. Assume now that a vehicle 2 is coming into the optical sensor device 41 as shown in FIG. 6. Then, the CPU 30 reads the state of the light receiving elements L1 to L16 of the vertical portion 43*a* set when the light receiving element S7 of the horizontal portion 43*b* becomes dark. In this example, information indicating that the light receiving elements L3 to L6 are set in the dark state is obtained. After this, the same process is effected for each of the light receiving elements S6 to S1 so as to obtain profile information of the front end portion of the vehicle 2 as shown in FIG. 9.

Figure 9:
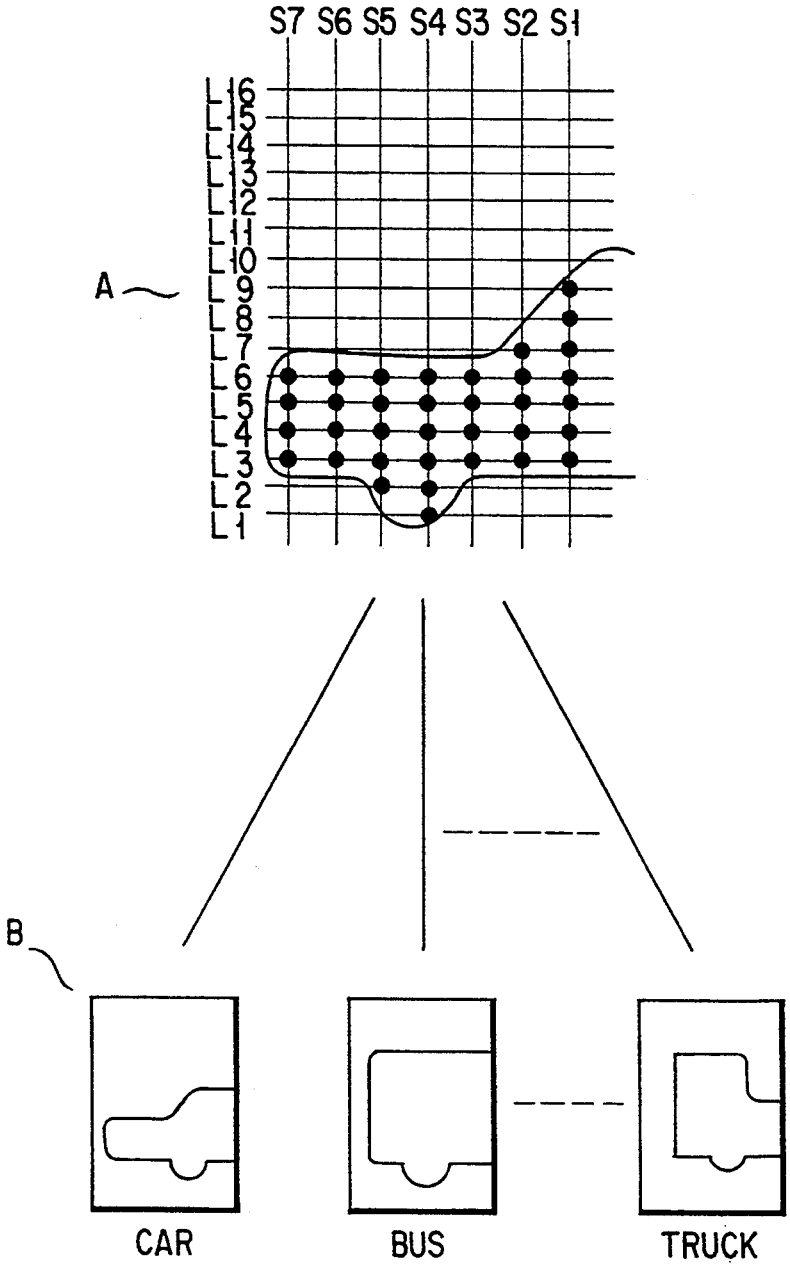
FIG. 9 is a diagram for illustrating a process of pattern matching between the profile information of the front end portion of the vehicle and reference information in this invention.

Next, the CPU 30 uses the thus detected profile information as input information (input pattern), effects the process of pattern matching between the profile information and reference information items (reference patterns) previously registered in the ROM 32 as shown in FIG. 9, derives similarities between them and detects the reference pattern which causes the largest similarity so as to determine the vehicle type.

Figure 8:
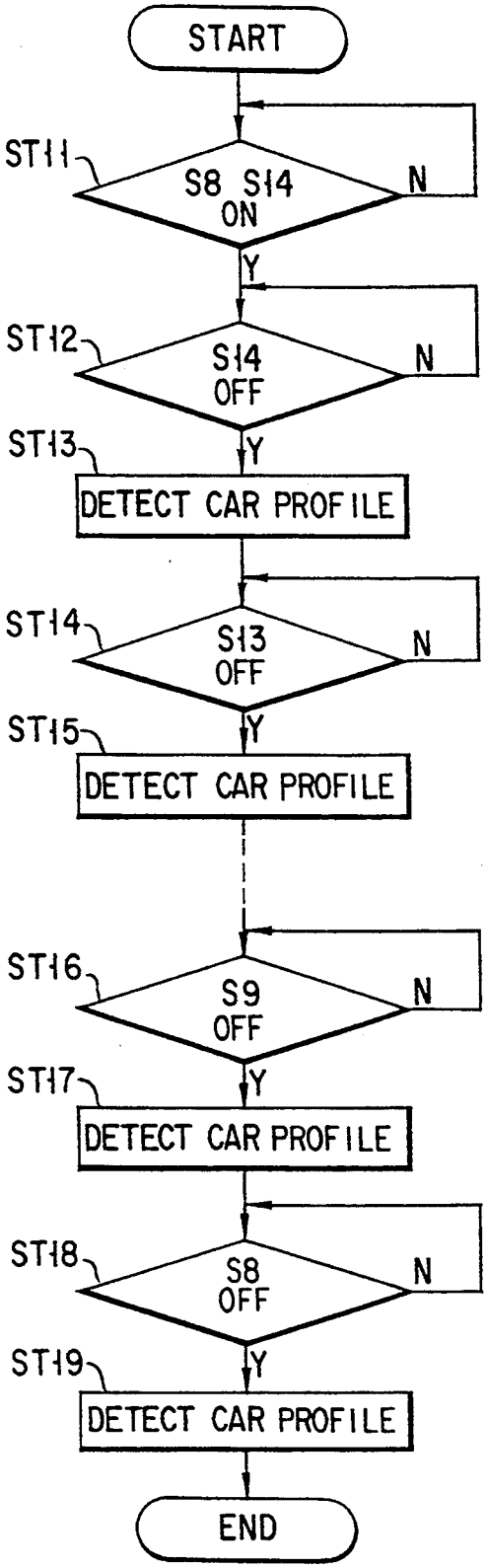
FIG. 8 is a flowchart for illustrating the operation of detecting profile information of the rear end portion of a vehicle in this invention.

Further, the CPU 30 detects profile information of the rear end portion by effecting the same operation after detection of the profile information of the front end portion. In this case, as shown by the flowchart of FIG. 8, the profile information of the rear end portion of the vehicle is obtained by reading the state of the light receiving elements L1 to L16 of the vertical portion 43*a* set when the light receiving elements S14 to S8 of the horizontal portion 43*b* are sequentially set into the bright state. Then, the vehicle type is determined by using the detected profile information as input information and effecting the same pattern matching process as described before.

The above explanation is made for a case wherein the vehicle 2 comes into the optical sensor device 41, but the same explanation may be made for a case wherein the vehicle 2 goes out from the optical sensor device 41.

According to the above embodiment, the profile information of the side surface of the vehicle can be derived as the absolute length based on the interval between two of the light receiving elements S1 to S14 irrespective of the velocity of the vehicle 2, and profile correction becomes unnecessary.

Figure 10:
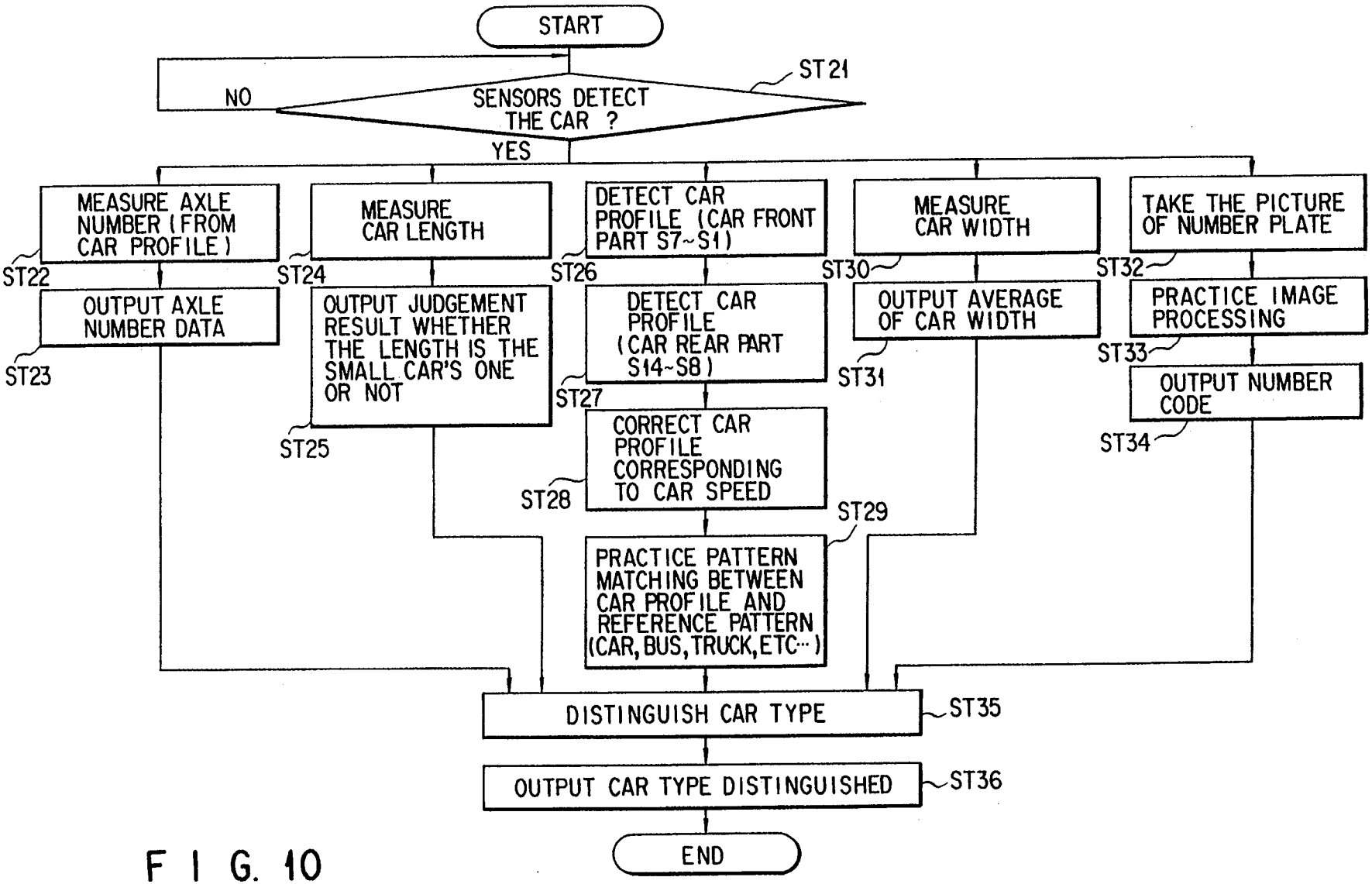
FIG. 10 is a flowchart for illustrating an example of a vehicle type identification method of this invention.

Further, FIG. 10 shows an example of the flowchart showing the process of vehicle type identification according to this invention. In this flowchart, it is first checked in this invention whether detection of a vehicle should be finished or not (ST21). If it is "YES" at this time, namely detection is finished, mainly the following five processes are effected and the results of the processes are finally used in the process of general judgment (ST35) for the vehicle type.

That is, the axles of a vehicle whose type is to be determined are detected based on the profile thereof (ST22) and the number of axles is output (ST23).

Further, the vehicle length is determined based on the profile data or both of the profile data and the velocity of the vehicle (ST24). Next, it is checked based on the vehicle length data whether the vehicle is a light vehicle or not and the result of the checking process is output (ST25).

In addition, the profile of the front half portion of the vehicle is detected by use of the photosensors 4 and 5 or 41 and 42 (ST26). Next, the profile of the rear half portion of the vehicle is detected (ST27). Then, the profile data is corrected with respect to the traveling direction of the vehicle according to the velocity of the vehicle (ST28). At this time, if the velocities of the vehicle when the profiles of the front half portion and rear half portion of the vehicle are detected are different from each other, the correction amounts will become different from each other. Next, the detected output line data is compared with the comparison reference pattern data items for a vehicle, bus, truck and the like stored in the memory 32 by effecting the pattern matching process (ST29).

Further, the vehicle width is measured by use of the vehicle width measuring ultrasonic sensors 13 and 14 (ST30). Then, the average value of the vehicle width data is derived and output (ST31).

Next, the licence plate of the vehicle is photographed by the photographing unit 18. Then, the photographing data is subjected to a predetermined image processing operation to determine a number code (ST33). After this, the number code is determined based on the processed image and then output (ST34).

Finally, by taking all of the axle number data of the vehicle, the result of determination whether it is a light vehicle or not, the result of pattern matching process, data of the average of the vehicle widths and data of number code into consideration, the vehicle type of the vehicle is determined (ST35). With the above general judgment, even if the photographed image of the licence plate is unclear and the result of number code is not correct or the Judgment of the vehicle length is not identify, the type of the vehicle can be correctly determined by using the above results to compensate for each other.

As described above, according to this invention, a vehicle type identification system whose durability, reliability and identification precision can be enhanced and which is easily installed can be provided.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A vehicle identification apparatus for identifying a vehicle type, the apparatus comprising:

first detecting means for detecting a passage of a vehicle, the first detecting means having a plurality of first light detecting elements, the first light detecting elements being disposed so as to be substantially parallel to a passage direction of the vehicle, each of said first light detecting elements successively detecting the passage of the vehicle;

second detecting means for detecting a profile of the vehicle, the second detecting means having a plurality of second light detecting elements disposed perpendicular to the passage direction of the vehicle, the second detecting means repeatedly detecting a part of the profile of the vehicle in accordance with the detected passage of the vehicle by the first detecting means;

means for storing a plurality of reference profiles;

means for comparing the profile detected by the second detecting means with at least one of the reference profiles; and means for identifying the vehicle type based upon the comparison made by the comparing means.

2. The apparatus according to claim 1, wherein the identifying means includes pattern matching means for matching a first front portion of at least one of the reference profiles with a second front portion of the vehicle profile.

3. The apparatus according to claim 1, wherein the first detecting means and the second detecting means are arranged in a "+"-shaped configuration.

4. The apparatus according to claim 1, wherein the first light detecting elements are substantially arranged in a linear fashion.

* * * * *